US005277617A

United States Patent [19]

Shasteen

[11] Patent Number: 5,277,617

[45] Date of Patent: Jan. 11, 1994

[54] VERSATILE ELECTRICAL CONNECTOR HOUSING

[75] Inventor: Sam S. Shasteen, Greenville, S.C.

[73] Assignee: Woven Electronics Corporation, Greenville, S.C.

[21] Appl. No.: 977,094

[22] Filed: Nov. 16, 1992

[51] Int. Cl.[5] ..... H01R 13/58

[52] U.S. Cl. ..... 439/465; 439/460

[58] Field of Search ..... 439/456, 457, 459, 460, 439/465, 467, 499

[56] References Cited

U.S. PATENT DOCUMENTS 4,734,055 3/1988 Misu ..... 439/456

4,925,401 5/1990 Fogg et al. ..... 439/465

FOREIGN PATENT DOCUMENTS 2245266 4/1975 France ..... 439/456

*Primary Examiner*—Eugene F. Desmond

*Attorney, Agent, or Firm*—Gerald R. Boss; Cort Flint

[57] ABSTRACT

A versatile electrical connector housing 12 with strain relief, includes a first housing section 26 and a second housing section 30. First back ridge 44 being offset from and in combination with a second back ridge 48 provide a strain relief. A vertical passage 50 in combination with a horizontal passage 52 allows an electrical transmission cable 16 to enter into the electrical connector within the profile of the electrical connector.

18 Claims, 2 Drawing Sheets

VERSATILE ELECTRICAL CONNECTOR HOUSING

BACKGROUND OF THE INVENTION

The invention relates to a back housing for a multi-position electrical connector which terminates a flat electrical transmission cable, and, in particular, to a housing having a slotted entrance passage which provides versatile routing of the cable either 180 or 90 degrees from the housing and increased strain relief.

Strain relief devices protect the integrity of the connections made between an electrical transmission cable and an electrical connector. As a force is applied to the electrical transmission cable, the strain relief device provides resistance to the force preventing any destruction of the connections between the electrical transmission cable and an electrical connector.

Previous strain relief features in electrical connectors have included mechanical clampings and potting compositions. The clamps limit the versatility in which the cable may be routed from the housing. Potting composition basically consists of filling the back shell with an epoxy which cements the electrical transmission cable within the connector housing. The use of potting compositions requires additional steps and materials in the termination process.

U.S. Pat. No. 4,111,512 discloses a common strain relief in which a tortuous path is created by requiring the electrical transmission cable to turn upon itself. As a result, the cable extends beyond the profile of the connector housing, and utilizes more space than the physical strain relief assembly. A problem with such a strain relief occurs in many applications because the space in the chassis for placing the electrical connector is limited. In applications where the cable enters the housing at a bend such as 90 degrees, extension of the cable past the housing makes installation difficult. The space constraints make it infeasible to waste space beyond the profile housing containing the strain relief.

Accordingly, an object of the present invention is to provide a back housing for an electrical connector which affords strain relief protection to an electrical transmission cable and requires minimal clearance between the cable and an associated electrical housing as the cable terminates into the electrical connector.

Additional problems arise where the strain relief restricts the flexibility of the electrical transmission cable in connection with the electrical connector. Most strain reliefs only provide for relief in one dimension and hence limit the incorporation of such strain reliefs to applications in which that one dimension is available. U.S. Pat. No. 4,493,523 discloses a plug for a standard electrical cord which provides routing of the cord at 90 degrees from the plug housing.

Henceforth, another object of the present invention is to provide the electrical transmission cable with the capability of versatile routing allowing the cable to enter the electrical connector with strain relief at various angles in conjunction with providing a strain relief with any desired routing.

SUMMARY OF INVENTION

The above objectives are accomplished according to the invention by providing a versatile electrical connector housing with strain relief for terminating an electrical transmission cable into a multi-position electrical connector. The versatile electrical connector housing with strain relief has a housing which includes a first and second base with a front portion to accommodate a multi-position electrical connector and an interior for receiving an electrical transmission cable. A back slot opening is formed in the back of the housing for entry of an electrical transmission cable. Two back ridges extend perpendicular from the bases but are offset vertically and horizontally from one another. The ridges in combination with each other and an opposite base form a vertical passage and a horizontal passage which form the back slot opening. The offset back ridges provide a strain relief for the electrical transmission cable as it is routed into the versatile electrical connector housing in a tortuous path. The configuration of the back slot opening allows the electrical transmission cable to enter into the versatile electrical connector housing at a 90 or 180 degree angle while still remaining within the profile of the versatile electrical connector housing. The back housing may be advantageously attached to the front electrical connectors by hook-shaped latches which fit in grooves formed in the connector, and allow the back housing to be attached in reverse position for versatility.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
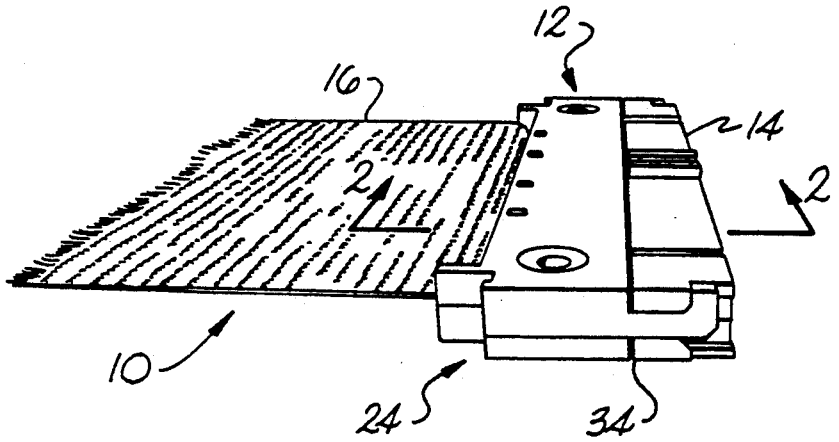
FIG. 1 is a perspective view illustrating the electrical connector assembly with the electrical transmission cable entering the versatile electrical connector housing with strain relief at a 180 degree angle.

Referring now in more detail to the drawings, an electrical connector assembly 10 is illustrated comprising an electrical connector housing 12 with strain relief, a multi-position electrical connector 14 and an electrical transmission cable 16. The multi-position electrical connector 14 has a plurality of connector positions 18 arranged along its face in order to connect to an object such as a printed circuit (PC) board 20. The electrical transmission cable 16 is then soldered to pads 22 located on the printed circuit (PC) board 20. Electrical transmission cable 16 may be any suitable flat ribbon such as a woven cable disclosed in U.S. Pat. No. 4,143,236, incorporated herein by reference.

The electrical connector housing 12 with strain relief includes a back shell or housing 24 comprising a first housing section 26 having a first base 28 and a second housing section 30 having a second base 32. The electrical connector housing 12 with strain relief further includes a front portion 34 comprising a first front portion 36 and a second front portion 38. The multi-position electrical connector 14 extends along front portion 34. The first housing section 26 is located opposite from the second housing section 30 so that an interior 40 is formed to receive the electrical transmission cable 16 and the printed circuit (PC) board 20. In the illustrated embodiment, the electrical connector is carried on the front of the electrical connector housing 12.

Figure 2:
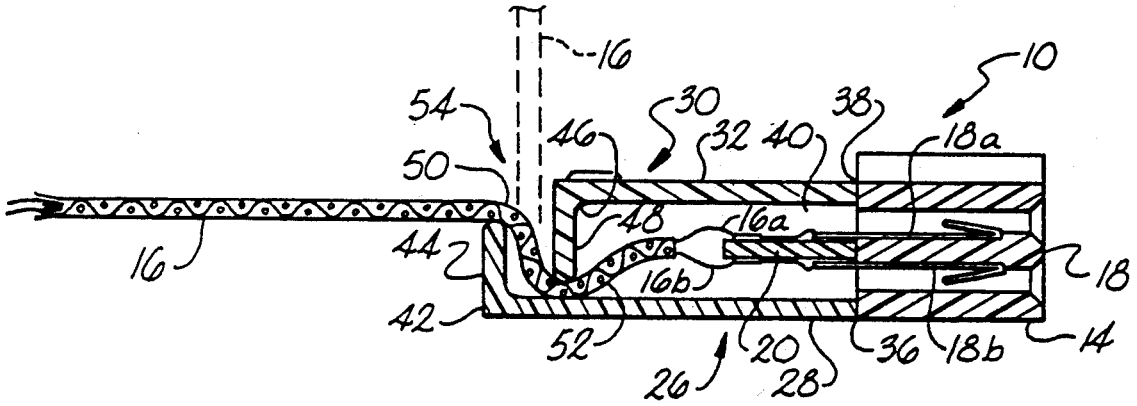
FIG. 2 is a sectional view taken along line 2—2 of FIG. 1.
Figure 4:
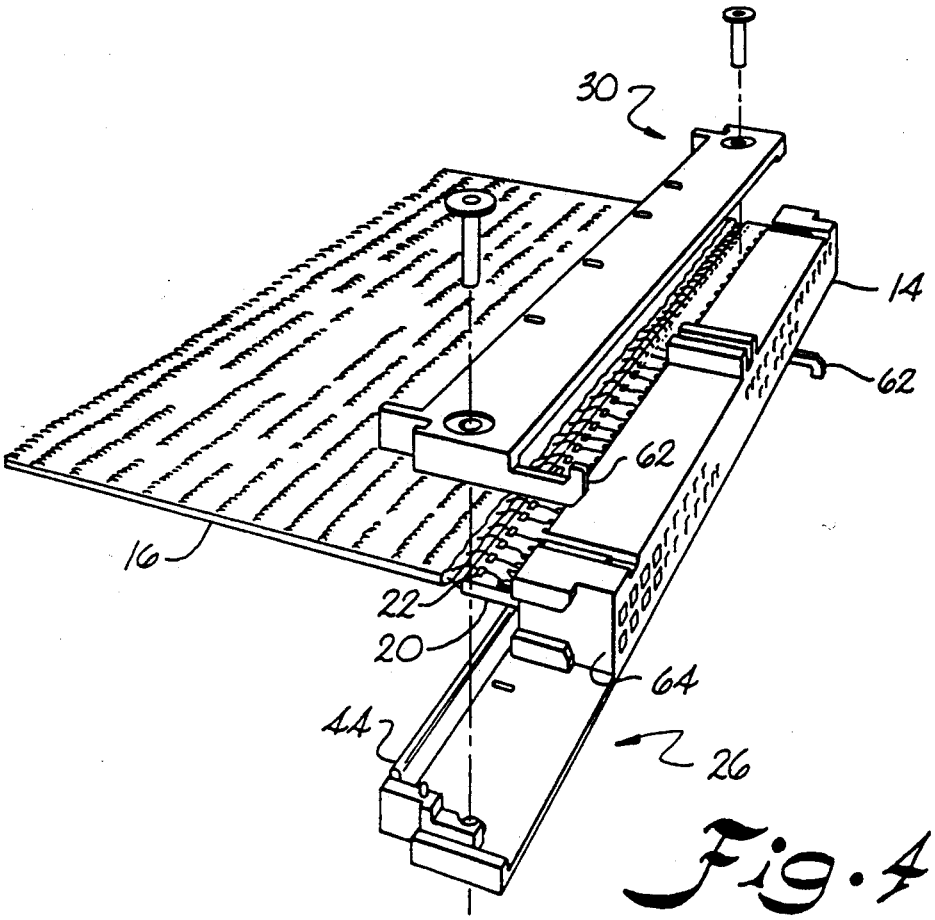
FIG. 4 is an exploded view of the connector assembly.
Figure 5:
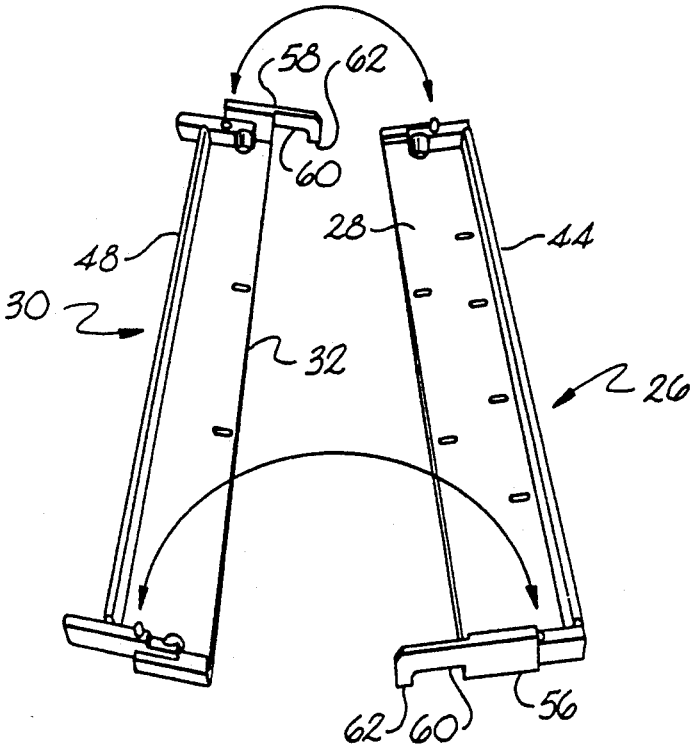
FIG. 5 is a view of the versatile electrical connector housing with strain relief housing members.

The first housing section 26 also includes a first end wall 42 which terminates into a first back ridge 44. The first back ridge 44 is best illustrated in FIGS. 2,4 and 5. The second housing section 30 also includes a second end wall 46 which terminates into a second back ridge 48 as best illustrated in FIG. 5. End walls 42 and 46 extend towards each other so that their respective back ridges 44, 48 may combine together in order to provide a strain relief for the electrical transmission cable. FIG. 2 illustrates the first end wall 42, the second end wall 46 and first base 28 combining together to form a strain relief.

First back ridge 44 is longitudinally offset from second back ridge 48 forming a generally vertical passage 50. The first back ridge 44 extends past the second back ridge 48 but below the second base 32 so that the entrance opening of the vertical passage 50 is below the second base 32. The second back ridge 48 is spaced from the first base 28 forming a generally horizontal passage 52. The combination of the vertical passage 50 with the horizontal passage 52 form a back slot opening 54 which routes the electrical transmission cable 16 into interior 40.

Figure 3:
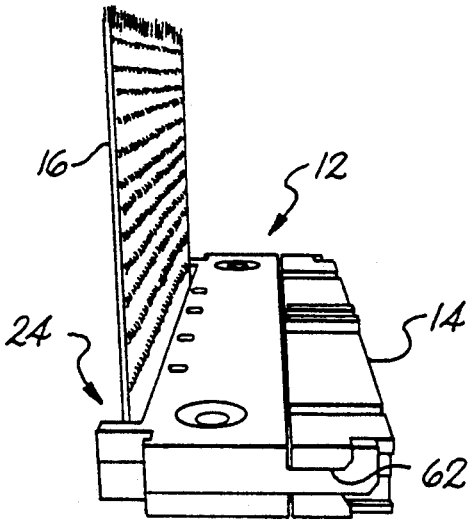
FIG. 3 is a perspective view illustrating the electrical transmission cable entering the versatile electrical connector housing with strain relief at a 90 degree angle.

The combination of the vertical passage 50 and the horizontal passage 52 allows the electrical transmission cable 16 to pass over and under both ridges and hence enter the interior 40 at an angle parallel to a plane defined by the connector positions 18. Alternately, electrical transmission cable 16 may pass under the second back ridge 48 and hence enter the interior 40 at an angle perpendicular to a plane defined by the connector positions 18, as can best be seen in the dotted line position of FIG. 2. This provides a versatile routing for the electrical transmission cable 16 in respect to its connection with the a printed circuit (PC) board 20. The conductors 16*a* and 16*b* of the electrical transmission cable are terminated to PC board 20. PC board 20 is terminated to contacts 18*a* and 18*b* of connector positions 18. As shown in FIGS. 1 and 3, the electrical transmission cable 16 is able to be routed within the profile of the electrical connector housing 12 with strain relief at both a 90 and 180 degree angle. The profile is defined by a first plane coplanar with base 32 and a second plane coplanar with end wall 42.

As illustrated in FIG. 5, the first housing section 26 includes a first latching member 56 and the second housing section 30 contains a second latching member 58. Each of the first and second latching members 56, 58 have an extension element 60 which terminates in a hook element 62 in order to secure the first housing section 28 and the second housing section 30 to the grooves 64 of the multi-position electrical connector 14. As seen in FIGS. 4 and 5, the first and second latching members 56, 58 have their respective hook element 60 opened in opposite directions. This allows the electrical connector housing 12 to be connected with the multi-position electrical connector 14 so that the vertical passage 50 is opened in an upwards or downwards direction.

While a preferred embodiment of the invention has been described using specific terms, such description is for illustrative purposes only, and it is to be understood that changes and variations may be made without departing from the spirit or scope of the following claims.

What is claimed is:

1. An electrical connector assembly having a multi-position electrical connector for terminating an electrical transmission cable, said electrical connector assembly comprising:

a multi-position electrical connector having a plurality of connector positions;

a housing having first and second bases of general length and width and a front portion for carrying said multi-position electrical connector;

a back slot opening formed in a rear of said housing for receiving said electrical transmission cable;

said housing having an interior which receives said electrical transmission cable routed through said back slot opening;

said first base terminating in a first end wall, and said first end wall terminating in a first back ridge;

said first back ridge extending from and across a width of said first base;

said second base terminating in a second end wall, and said second end wall terminating in a second back ridge;

said second back ridge extending from and across a width of said second base in a direction towards said first base;

said first back ridge being longitudinally offset from said second back ridge to form a generally vertical passage having an entrance opening;

said second back ridge being spaced from said first base forming a generally horizontal passage;

said generally vertical and horizontal passages forming said back slot opening for receiving said electrical transmission cable and for leading into said interior;

said first back ridge in combination with said second back ridge being arranged for engaging said electrical transmission cable as it is routed through said vertical and horizontal passages to afford a strain relief for said electrical transmission cable when said cable is in longitudinal alignment with said electrical connector.

2. The housing of claim 1 wherein said first back ridge extends past said second back ridge providing increase resistance and a strain relief for said electrical transmission cable.

3. The assembly of claim 1 wherein said first back ridge defines a generally vertical plane and said second base defines a generally horizontal plane delineating a profile of said housing, and said entrance opening is spaced below said generally horizontal plane.

4. The assembly of claim 3 wherein said offset of said back ridges allows said electrical transmission cable to enter said back opening at various angles ranging from being generally parallel to said horizontal plane and generally parallel to said vertical plane with said electrical transmission cable being retained within said profile at either angle.

5. The assembly of claim 1 where said housing includes a first housing section and a second housing section which mate together.

6. The assembly of claim 5 wherein said first housing section can be interchanged with said second housing section such that said entrance opening of said vertical passage can be reversed and opened vertically upward or downward.

7. The assembly of claim 1 wherein said multi-position electrical connector is carried exteriorly at said front portion of said housing, said housing having a first and second latching means respectively to interconnect with said multi-position electrical connector in an integral manner.

8. A connector housing apparatus for terminating an electrical transmission cable into a multi-position electrical connector having a plurality of connector positions, said connector housing apparatus comprising:

a first housing section having a first base of general length and width and a first front portion for carrying said multi-position electrical connector;

a second housing section having a second base of general length and width and a second front portion to accommodate said multi-position electrical connector;

said first housing section being disposed opposite from said second housing section;

said first housing section in combination with said second housing section forming an interior which receives said electrical transmission cable;

said first housing section terminating in a first end wall, and said first end wall terminating in a first back ridge;

said first back ridge extending generally perpendicular from and across a width of said first base;

said second housing section terminating in a second end wall, and said second end wall terminating in a second back ridge;

said second back ridge extending generally perpendicular from and across a width of said second base in a direction towards said first base;

said first back ridge being longitudinally offset from said second back ridge to form a generally vertical passage having an entrance opening;

said second back ridge being spaced from said first base forming a generally horizontal passage;

said generally vertical and horizontal passages forming a back slot opening for receiving said electrical transmission cable and for leading into said interior;

said first back ridge in combination with said second back ridge being arranged for engaging said electrical transmission cable as it is routed through said vertical and horizontal passages to afford a strain relief for said electrical transmission cable when said cable is in longitudinal alignment with said electrical connector.

9. The apparatus of claim 8 wherein said first back ridge extends past said second back ridge providing increase resistance and a strain relief for said electrical transmission cable.

10. The apparatus of claim 8 wherein said first back ridge defines a generally vertical plane and said second base defines a generally horizontal plane delineating a profile of said housing, and said entrance opening is spaced below said generally horizontal plane.

11. The apparatus of claim 10 wherein said offset of said back ridges allows said electrical transmission cable to enter said back opening at various angles ranging from being generally parallel to said horizontal plane and generally parallel to said vertical plane with said electrical transmission cable being retained within said profile at either angle.

12. The apparatus of claim 8 wherein said first housing section can be interchanged with said second housing section such that said entrance opening of said vertical passage can be reversed and opened vertically upward or downward.

13. A connector housing apparatus for terminating an electrical transmission cable into a multi-position electrical connector having a plurality of connector positions, said connector housing apparatus comprising:

a first housing section having a first front portion for adapting said mulit-position electrical connector;

a first latching means for interconnecting said first housing section to a first complimentary portion of said multi-position electrical connector;

a second housing section having a second front portion for adapting said multi-position electrical connector;

a second latching means for interconnecting said second housing member to a second complimentary portion of said multi-position electrical connector;

said first and second housing sections mating together in a superposed manner to form a back shell with said first and second latching means interconnected with said first and second complimentary portions;

said back shell having an interior which receives said electrical transmission cable;

a back slot opening formed in said back shell for receiving said electrical transmission cable;

said first housing section terminating in a first end wall, and said first end wall having a first back ridge and said second housing section terminating in a second end wall having a second back ridge;

said first end wall being longitudinally offset from said second end wall to form a generally vertical passage having an entrance opening for receiving said electrical transmission cable;

said second back ridge being spaced from said first housing section forming a generally horizontal passage; and said generally vertical and horizontal passages forming said back slot opening for receiving said electrical transmission cable and for leading into said interior;

said first back ridge in combination with said second back ridge being arranged for engaging said electrical transmission cable as it is routed through said vertical and horizontal passages to afford a strain relief for said electrical transmission cable when said cable is in longitudinal alignment with said electrical connector.

14. The apparatus of claim 13 wherein said first and second latching means include a latch extension enjoining said first and second complimentary portions.

15. The apparatus of claim 14 wherein said latch extension allows said first and second housing sections to interconnect with either said first and second complimentary portions.

16. The apparatus of claim 14 wherein said latch extension terminates in a hook member enjoining said first and second complimentary portions.

17. The apparatus of claim 14 wherein said complimentary portions have grooves for receiving said hook member.

18. The apparatus of claim 13 wherein said first housing section can be interchanged with said second housing section such that said back opening formed by said vertical and horizontal passages can be opened vertically upward or vertically downward.

* * * * *